US007945191B2

(12) United States Patent
Shirai

(10) Patent No.: US 7,945,191 B2
(45) Date of Patent: May 17, 2011

(54) IMAGE FORMING APPARATUS HAVING EXTERNAL-ADDITIVE REMOVAL UNIT THAT INCLUDES A CONDUCTIVE BLADE

(75) Inventor: Masaharu Shirai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/548,766

(22) Filed: Aug. 27, 2009

(65) Prior Publication Data

US 2010/0247190 A1 Sep. 30, 2010

(30) Foreign Application Priority Data

Mar. 25, 2009 (JP) ..... 2009-074310

(51) Int. Cl.
*G03G 21/00* (2006.01)

(52) U.S. Cl. ..... 399/129; 399/349; 399/350

(58) Field of Classification Search ..... 399/349, 399/350, 129, 343, 71, 98, 99, 48
See application file for complete search history.

(56) References Cited

U.S. PATENT DOCUMENTS

| | | | | |
|---|---|---|---|---|
| 4,259,003 | A * | 3/1981 | Mangal et al. | 399/129 |
| 4,982,239 | A * | 1/1991 | Kume et al. | 399/349 |
| 4,999,678 | A * | 3/1991 | Tange | 399/349 |
| 5,701,571 | A * | 12/1997 | Amamiya et al. | 399/343 |
| 6,975,823 | B2 * | 12/2005 | Onishi et al. | 399/129 X |
| 2006/0204296 | A1 * | 9/2006 | Maruyama et al. | 399/349 |
| 2007/0274749 | A1 * | 11/2007 | Ogasawara et al. | 399/350 |
| 2009/0092428 | A1 * | 4/2009 | Yano et al. | 399/349 |
| 2009/0129798 | A1 * | 5/2009 | Nishida et al. | 399/48 |
| 2010/0014901 | A1 * | 1/2010 | Kobashi et al. | 399/343 |

FOREIGN PATENT DOCUMENTS

| | | |
|---|---|---|
| JP | A-61-251887 | 11/1986 |
| JP | A-8-123287 | 5/1996 |
| JP | A-11-125938 | 5/1999 |
| JP | A-2002-156880 | 5/2002 |
| JP | A-2002-278315 | 9/2002 |
| JP | A-2004-170439 | 6/2004 |

OTHER PUBLICATIONS

Dec. 14, 2010 Office Action issued in Japanese Patent Application No. 2009-074310 (with translation).

* cited by examiner

*Primary Examiner* — Sophia S Chen
(74) *Attorney, Agent, or Firm* — Oliff & Berridge, PLC

(57) ABSTRACT

An image forming apparatus includes: an image holder; a charging unit that charges the image holder; a latent image forming unit; a developing unit that forms a toner image; a transfer unit that transfers the toner image formed on the surface of the image holder onto a recording medium; a toner-particle removal unit that removes toner particles remaining on the surface of the image holder after the transfer of the toner image by the transfer unit; and an external-additive removal unit that includes a conductive blade disposed to contact the surface of the image holder and removes, after the transfer of the toner image by the transfer unit, external additive remaining on the surface of the image holder using the conductive blade while applying a voltage to the surface of the image holder via the conductive blade.

21 Claims, 3 Drawing Sheets

IMAGE FORMING APPARATUS HAVING EXTERNAL-ADDITIVE REMOVAL UNIT THAT INCLUDES A CONDUCTIVE BLADE

CROSS-REFERENCE TO RELATED APPLICATION

This application is based on and claims priority under 35 USC 119 from Japanese patent Application No. 2009-074310 filed on Mar. 25, 2009.

BACKGROUND

1. Technical Field

The present invention relates to an image forming apparatus.

2. Related Art

Nowadays, image forming apparatuses, typical examples of which include printers and copiers, have been widely used, and technologies concerning various components of image forming apparatuses have spread widely. Among image forming apparatuses, there are image forming apparatuses using an electro-photographic image forming method, in which a desired pattern for printing is formed generally by charging a photoreceptor (image holder), such as a photoreceptor drum, with a charging device and forming, on the charged photoreceptor, an electrostatic latent image having an electric potential different from an area therearound. The formed electrostatic latent image is developed with toner, and finally the toner is transferred onto a recording medium such as recording paper.

Meanwhile, technologies aiming at cleaning spherical toner, which is hard to remove, off a surface of the photoreceptor have been reported.

SUMMARY

According to an aspect of the present invention, there is provided an image forming apparatus including: an image holder; a charging unit that charges the image holder; a latent image forming unit that forms a latent image on a surface of the charged image holder; a developing unit that develops the latent image formed on the surface of the image holder to form a toner image, using a toner including toner particles and an external additive; a transfer unit that transfers the toner image formed on the surface of the image holder onto a recording medium; a toner-particle removal unit that removes toner particles remaining on the surface of the image holder after the transfer of the toner image by the transfer unit; and an external-additive removal unit that includes a conductive blade disposed to contact the surface of the image holder and removes, after the transfer of the toner image by the transfer unit, external additive remaining on the surface of the image holder using the conductive blade while applying a voltage to the surface of the image holder via the conductive blade.

BRIEF DESCRIPTION OF THE DRAWINGS

Exemplary embodiments of the present invention will be described in detail based on the following figures, wherein:

Hereinafter, exemplary embodiments of the present invention are described with reference to the attached drawings. Members having substantially the same function and action are designated by the same reference numeral throughout the figures, and overlapping descriptions thereof are omitted.

FIG. 1 is a schematic view illustrating the configuration of an image forming apparatus according to the present exemplary embodiment.

As shown in FIG. 1, an image forming apparatus according to the present exemplary embodiment 101 includes a photoreceptor 10 (image holder), and, around the photoreceptor 10, a charging device 12 (charging unit) that charges the photoreceptor 10, an exposing device 14 (latent image forming unit) that forms a latent image by light-exposing the photoreceptor 10 charged by the charging device 12, a developing device 16 (developing unit) that develops the latent image formed by the exposing device 14 to form a toner image using a toner, a transfer device 18 (transfer unit) that transfers the toner image developed by the developing device 16 onto a recording medium P, a toner-particle cleaning device 20 (toner-particle removal unit) that removes toner particles remaining on the surface of the photoreceptor 10 after the transfer of toner image, an external additive cleaning device 22 (external-additive removal unit) that removes an external additive remaining on the photoreceptor 10 after the transfer, and a charge removal device 24 (charge removal unit) that removes a charge from the surface of the photoreceptor 10 after the transfer. The image forming apparatus 101 according to the present exemplary embodiment includes a fixing device 26 that fixes the toner image that has been transferred onto the recording medium P by the transfer device 18. In the image forming apparatus 101 according to the present exemplary embodiment, the toner is a toner including at least toner particles and an external additive.

Figure 1:
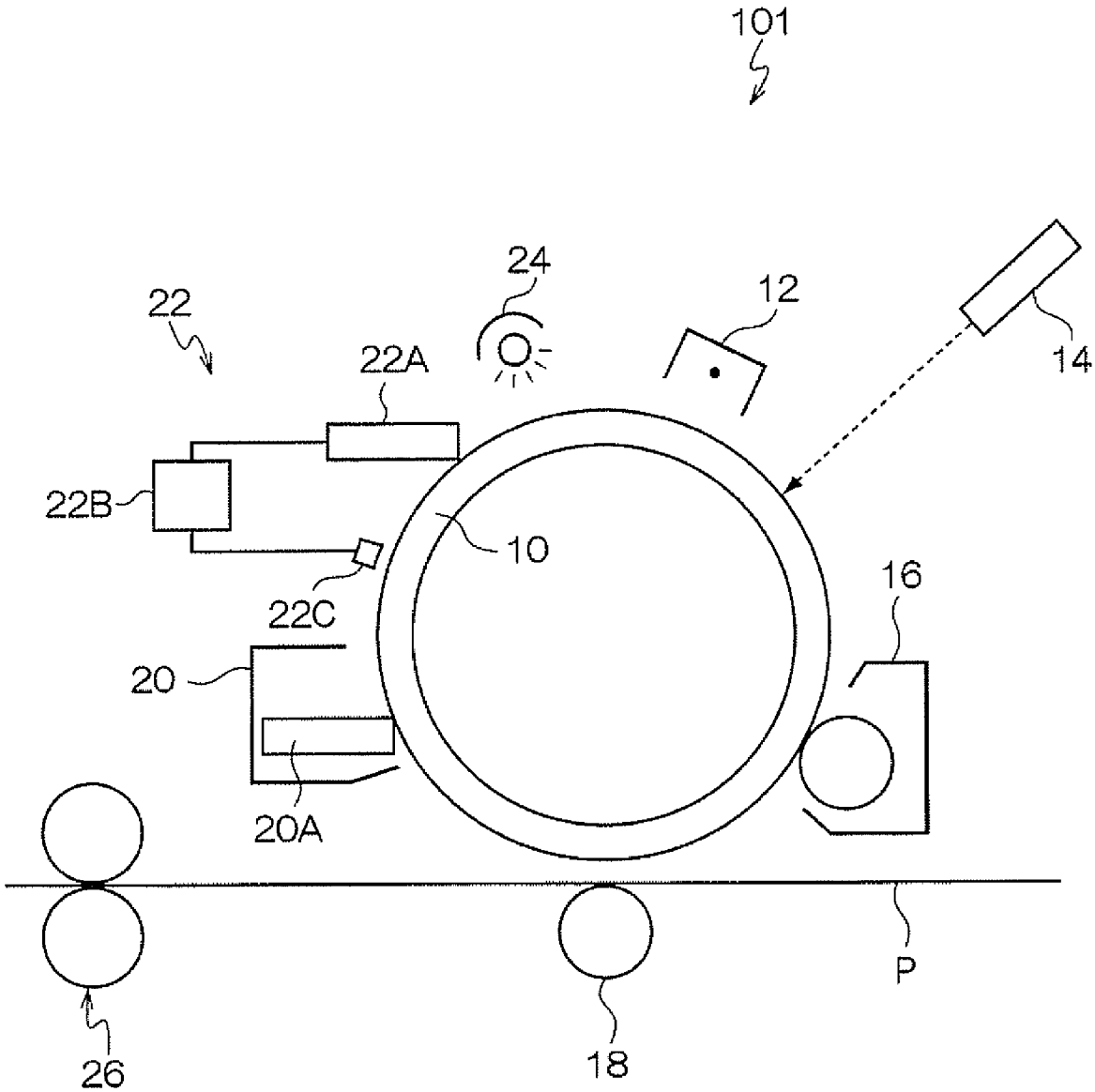
FIG. 1 is a schematic view illustrating the configuration of an image forming apparatus according to an exemplary embodiment of the present invention.

In the image forming apparatus 101 according to the present exemplary embodiment, configurations other than the external additive cleaning device 22 may be selected from known configurations that have been used as components of electrophotographic image forming apparatuses. In the following, examples of the components are described.

As the photoreceptor 10, known photoreceptors may be used without particular limitations. For example, an organic photoreceptor in which a charge generation layer and a charge transport layer are separated from each other, which is called a layered organic photoreceptor, may be used. As the photoreceptor 10, a photoreceptor having a surface layer, wherein the surface layer is coated with a charge-transporting protective layer having a crosslinked structure, may be used. A photoreceptor in which the crosslinked component in this protective layer is selected from at least one of a siloxane resin, a phenol resin, a melamine resin, a guanamine resin, or an acrylic resin, may be used. The material forming the protective layer is not limited to an organic material, and may be an inorganic material containing, for example, an a metal oxide.

As the charging device 12, for example, either a contact type charging device or a non-contact type charging device may be used. The form of the contact type charging device may be any of a roller, a blade, a belt, a brush, or the like, and may be selected according to the specification and form of the image forming apparatus. The non-contact type charging device may adopt any system, such as a scorotron or a corotron.

The exposing device 14 is, for example, a laser optical device or an LED(Light Emitting Diode) array optical device.

The developing device 16 is, for example, a developing device in which a developer retainer having a developer layer on a surface thereof is contacted with or disposed close to the photoreceptor 10, and the toner is attached to a latent image on a surface of the photoreceptor 10 to form a toner image. As the developing method used in the developing device 16, a generally-known developing method using a two-component developer may be used. Examples of the developing method using a two-component developer include a cascade method and a magnetic brush method.

The toner for forming a toner image includes toner particles and an external additive. The toner may have a well-known configuration, and may be used singly as a one-component developer or may be mixed with a carrier to be used as a two-component developer The toner particles may have a well-known structure including, for example, a binder resin, a colorant, a release agent, and the like. Examples of the external additive include known particles such as inorganic particles (for example, silica particles, titanium oxide particles, alumina particles, or cerium oxide particles) or resin particles (for example, particles of polycarbonate, poly(methyl methacrylate), or a silicone resin).

The transfer device 18 may be, for example, either a device using either a non-contact transfer method such as corotron or a scorotron or a contact transfer method in which a recording medium P is interposed between a conductive transfer roller and the photoreceptor 10 and a toner image is transferred to the recording medium P.

The toner-particle cleaning device 20 may be, for example, a device that includes a cleaning blade 20A and that removes toner particles and other materials (for example, paper dust and other contaminants) attaching to the surface of the photoreceptor 10 by directly contacting the blade 20A with the surface of the photoreceptor 10. The cleaning blade 20A that the toner-particle cleaning device 20 has may be arranged in a doctor system (a system in which the tip of the blade butts against the photoreceptor 10 in a direction opposite to the rotation direction of the photoreceptor 10). The toner-particle cleaning device 20 may use a member other than the cleaning blade, and examples thereof include a cleaning brush and a cleaning roller.

The external additive cleaning device 22 is, for example, a device that includes a conductive blade 22A and that removes external additives attaching to the surface of the photoreceptor 10 while directly contacting the conductive blade 22A with the surface of the photoreceptor 10 and applying a voltage to the surface of the photoreceptor 10.

Besides the conductive blade 22A, the external additive cleaning device 22 further includes an external additive cleaning controller 22B that adjusts a voltage applied by the conductive blade 22A to the surface of the photoreceptor 10, and an electric potential sensor 22C (an electric potential detection unit) that is connected to the external additive cleaning controller 22B and that detects the electric potential of the surface (surface of an image area) of the photoreceptor 10 after transfer.

As the electric potential sensor 22C (electric potential detection unit), for example, a surface electrometer may be used. Examples of the method of measuring the surface (surface of an image area) electric potential of the photoreceptor 10 after transfer with the electric potential sensor 22C include (i) a method of measuring an induced electric potential by bringing a probe electrode close to the surface of the photoreceptor 10, (ii) a method of measuring by converting the induced electric potential to an alternating signal by, for example, periodically vibrating the probe electrode positioned close to the surface of the photoreceptor 10 or opening and shutting the shutter provided in front of the probe electrode in an oscillatory manner, (iii) a method of measuring the intensity of the electric field in the vicinity of the surface of the photoreceptor 10. Among these methods, the method (ii) (detection method using a vibration-capacitor surface electrometer), which is suitable for accurately measuring the electric potential of a microscopic region of the surface of the photoreceptor 10, is preferable.

The external additive cleaning controller 22B includes a built-in bias power source (not shown) that supplies an electric power for applying a voltage to the surface of the photoreceptor 10 via the conductive blade 22A. The electric potential sensor 22C is, for example, provided to oppose the surface of the photoreceptor 10 at the downstream side of the toner-particle cleaning device 20 with respect to the rotation direction of the photoreceptor 10 but at the upstream side of the conductive blade 22A with respect to the rotation direction of the photoreceptor 10.

The conductive blade 22A that the external additive cleaning device 22 has may be provided at the downstream side of the toner-particle cleaning device 20 with respect to the rotation direction of the photoreceptor 10 but at the upstream side of the charge removal device with respect to the rotation direction of the photoreceptor 10. As a result, external additives may become to be easy to remove electrostatically, and ghosting caused by residual external additives on the photoreceptor 10 may be suppressed. It is considered that light-exposure by the charge removal device 24 is performed in the state in which external additives (charged external additives) attach to the surface of the photoreceptor 10, the external additives and counter chargers that have migrated from the base material to the surface of the photoreceptor 10 more readily be attracted to each other.

The conductive blade 22A may be disposed in a wiper system (a system in which the tip of the conductive blade, which is oriented toward the rotational direction of the photoreceptor 10, contacts with the photoreceptor 10). When the conductive blade is arranged in the wiper method, flipping of the blade tip in the rotation direction of the photoreceptor 10 may be suppressed.

The conductive blade 22A is a blade that has a length corresponding to the length of the image-forming area of the photoreceptor 10 (the length in the axial direction of the photoreceptor), and, in the conductive blade 22A, at least the portion contacting with the photoreceptor 10 is made of a conductive material. Regarding suitable conductivity, the volume resistivity of the conductive blade 22A is, for example, from $10^7$ Ωcm to $10^{12}$ Ωcm (or from about $10^7$ Ωcm to about $10^{12}$ Ωcm), and more preferably from $10^9$ Ωcm to $10^{11}$ Ωcm. If the volume resistivity is too low, electrical leakage may occur owing to presence of contaminants or abrasion of the photoreceptor 10. If the volume resistivity is too high, the ability to remove external additives may be reduced, and unevenness in cleaning may result.

Regarding the measurement of the volume resistivity, an electric current is measured when a voltage of 100 V is applied for 10 seconds using an R8340A (tradename) digital high-resistance/minute electric current meter manufactured by ADVANTEST Corp., and the volume resistivity is determined from the obtained electric current value. The measurement is conducted in an environment of 22° C., 55% RH.

Figure 3A:
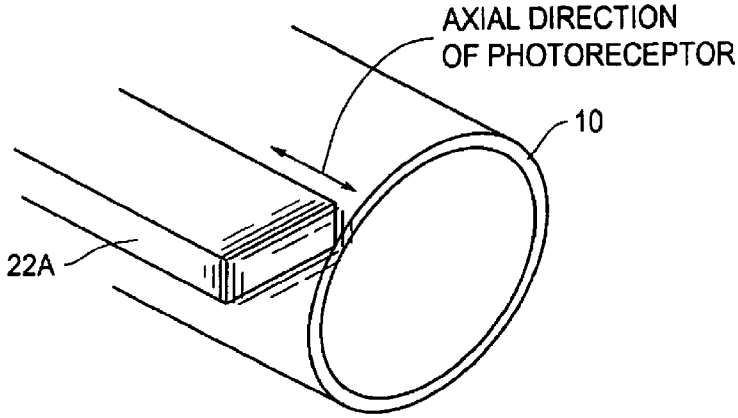
FIG. 3A is a view of the conductive blade vibrating in an axial direction of the photoreceptor.
Figure 3B:
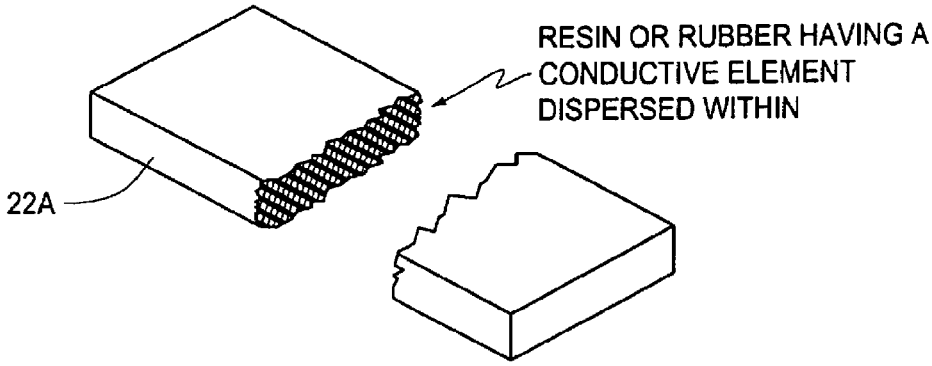
FIG. 3B is view of the structure of the conductive blade.
Figure 3C:
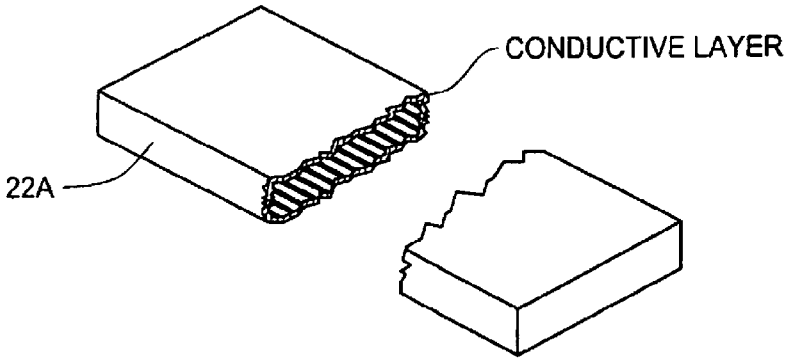
FIG. 3C is another view of the structure of the conductive blade.

Examples of the structure of the conductive blade 22A include (i) a structure including a resin or rubber in which a conductive agent is dispersed (FIG. 3B), and (ii) a structure in which a conductive layer containing a conductive agent is disposed on a blade including a resin or rubber (FIG. 3C).

Examples of the conductive agent include carbon (for example, graphite or carbon black), metal oxides (for example, tin oxide), ionic conductive agents (for example, perchlorates and chlorates, such as tetraethyl ammonium and lauryl trimethyl ammonium; perchlorates and chlorates of alkali metals such as lithium and magnesium; perchlorates and chlorates of alkali earth metals), and oxygen-deficient metal oxide powders (for example, oxygen-deficient tin oxide).

Examples of the resin include urethane, silicone polyester, polyamide, polyethylene, polycarbonate, polyolefin, polyurethane, polyvinylidene fluoride, polyimide, PEN (polyethylene naphthalate), PEK (polyetherketone), PES (polyethersulfone), PPS (polyphenylene sulfide), PFA (tetrafluoroethylene-perfluoroalkylvinylether copolymer), PVdF (polyvinylidene fluoride), ETFE (polyethylene-tetrafluoroethylene), and CTFE (chlorotrifluoroethylene). Examples of the rubber include synthetic rubbers such as silicone rubber, EPDM, ethylene propylene rubber, butyl rubber, acrylic rubber, urethane rubber, and nitrile rubber.

The conductive blade 22A preferably applies a voltage having the same polarity as the polarity of an image area of the surface of photoreceptor, more preferably applies a voltage of the same (or substantially the same) electric potential as the potential Vb of the surface of the photoreceptor 10 in an area on which a toner image is formed (the surface potential Vb of an image area). That is, it is preferable to inject electric charges to the surface of photoreceptor 10 through the conductive blade 22A, so as to equalize the electric potentials of an image area and a non-image area on the surface of the photoreceptor 10. As a result, external additives of the toner may become to be easily removed electrostatically by the conductive blade 22A, and ghosting caused by residual external additives on the photoreceptor 10 may be suppressed. Here, the expression, "the same potential", means that the potential difference from Vb is within ±10 V, preferably within ±5 V.

The voltage applied through the conductive blade 22A may be a voltage in which an alternating voltage is superposed on a direct voltage. It is considered that application of a voltage in which an alternating voltage is superposed on a direct voltage to the surface of the photoreceptor 10 via the conductive blade 22A results in vibration of external additives of the toner and makes it easy for the external additives to separate from the surface of the photoreceptor 10, so that electrostatic removal of the external additives may be made easier and ghosting caused by the residual external additives on the photoreceptor 10 may be suppressed.

The alternating component of the superimposed voltage in which an alternating voltage is superposed on a direct voltage preferably has a frequency f of from 0.5 KHz to 3 KHz and a peak-to-peak voltage Vp-p of from Vb/4 to Vb/1, more preferably has a frequency f of from 1 KHz to 2.5 KHz and a peak-to-peak voltage Vp-p of from Vb/3 to Vb/1.4, and still more preferably has a frequency f of from 1.5 KHz to 2 KHz and a peak-to-peak voltage Vp-p of from Vb/2.5 to Vb/1.6, wherein Vb represents the electric potential of the surface of the photoreceptor 10 in an image area. By regulating the alternating component to be within the above range, increase in the abrasion of the photoreceptor 10 caused by the conductive blade 22A and occurrence of electrical leakage in the photoreceptor 10 may be suppressed, electrostatic removal of external additives may become easy, and ghosting caused by residual external additives on the photoreceptor 10 may be suppressed.

The conductive blade 22A is preferably disposed so as to contact with the surface of the photoreceptor 10 under a normal stress of from 0.5 gf/cm to 3.5 gf/cm (or from about 0.5 gf/cm to about 3.5 gf/cm), preferably from 1.0 gf/cm to 3.0 gf/cm, and more preferably from 1.5 gf/cm to 2.5 gf/cm. When the normal stress of the conductive blade 22A is regulated to be within the above range, roughening of the surface of the photoreceptor 10 caused by repeated electrophotographic processes may be suppressed, generation of non-contact areas between the conductive blade 22A and surface of the photoreceptor 10 caused by rotation of the photoreceptor 10 may be suppressed, and failures, such as tendency of the blade tip to chatter-vibrate and excessive abrasion of the photoreceptor 10, may be inhibited. As a result, physical removal of external additives becomes easier and ghosting caused by residual external additives on the photoreceptor 10 may be suppressed while excessive contact pressure between the conductive blade 22A and the surface of the photoreceptor 10 may be avoided.

Here, normal stress is measured as follows. Two load cells are disposed, and the distance therebetween is set to 75% of the length of the conductive blade 22A. The measurement surfaces of the load cells are on the same plane. A rigid metal plate having an appropriate thickness and width is attached to the two measurement surfaces so as to serve as a bridge between the two measurement surfaces. A jig is prepared with which the position of the surface of the metal plate can be adjusted to coincide with the position of the surface of the photoreceptor 10. Here, the metal plate has sufficient length and width for contact with the conductive blade 22A, and has such a rigidity that the metal plate is not bent by the contact with the conductive blade 22A. The photoreceptor 10 is replaced by the jig, and load is measured with the load cells when the conductive blade 22A depresses the metal plate to the same degree as when the conductive blade 22A presses into the surface of photoreceptor 10, wherein the values of both load cells are set to zero before the conductive blade 22A depresses the surface of the metal plate. When the value measured by each load cell is designated by F gf (both load cells show the same value and the length of the conductive blade 22A is designated by L (cm), the normal stress is obtained as a value 2 F/L gf.

The conductive blade 22A may be vibrated in the axial direction of the photoreceptor 10. Owing to the vibration, roughening of the surface of the photoreceptor 10 caused by repeated electrophotographic processes may be suppressed, generation of non-contact areas between the conductive blade 22A and surface of the photoreceptor 10 caused by rotation of the photoreceptor 10 may be suppressed, and, as a result, physical removal of external additives may become easier and ghosting caused by residual external additives on the photoreceptor 10 may be suppressed.

The conductive blade 22A is preferably vibrated in the axial direction of the photoreceptor 10 (FIG. 3A) with an amplitude of from 1 mm to 10 mm (or from about 1 mm to about 10 mm) and a frequency of from 0.1 cyc/sec to 15 cyc/sec (or from about 0.1cyc/sec to about 15 cyc/sec), preferably with an amplitude of from 2 mm to 7 mm and a frequency of from 0.25 cyc/sec to 10 cyc/sec, and more preferably with an amplitude of from 2.5 mm to 5.0 mm and a frequency of from 1 cyc/sec to 5 cyc/sec. By vibrating the conductive blade 22A in a specific manner, the blade is vibrated while the shape of the blade tip is maintained, and, as a result, physical removal of external additives may become easier and ghosting caused by residual external additives on the photoreceptor 10 may be suppressed.

Examples of the mechanism for vibrating the conductive blade 22A include known mechanisms, such as a mechanism in which a supporting member supporting the conductive blade 22A is pressed against, for example, an eccentric cam by an elastic member (for example, a spring) and the blade is vibrated by the rotation of the eccentric cam.

Examples of the charge removal device 24 include a tungsten lamp that emits white light and an LED (Light Emitting Diode) that emits red light.

The fixing device 26 may be a heat fixing device that uses a heat roller. The heat fixing device includes, for example, a fixing roller and a pressure roller or pressure belt; the fixing roller includes a cylindrical core metal, a heater lamp for heating provided at the inner side of the cylindrical core metal, and a releasing layer provided on the outer circumferential surface of the cylindrical core metal and formed from a heat resistant resin coating layer or a heat resistant rubber coating layer, and the pressure roller or pressure belt includes a cylindrical core metal and a heat resistant elastic layer provided on the outer circumferential surface of the cylindrical core metal or includes a belt substrate and a heat resistant elastic layer provided on a surface of the belt substrate, and is disposed to contact the fixing roller at a specific contact pressure. Fixing of an unfixed toner image is performed, for example, by passing a recording medium P, to which an unfixed toner image has been transferred, between the fixing roller and the pressure roller or pressure belt, so as to thermally melt a binder resin, an additive, and the like contained in the toner In the image forming apparatus 101 according to the present exemplary embodiment, first, a surface of the photoreceptor 10 is charged by a charging device 12. Then, a latent image is formed on the surface of the photoreceptor 10 by irradiating the charged surface of the photoreceptor 10 with light using an exposing device 14. Then, toner is supplied to the surface of the photoreceptor 10 having the latent image using a developing device 16, thereby developing, with the toner, the latent image formed on the surface of the photoreceptor 10, so as to form a toner image. Thereafter, the toner image formed on the surface of the photoreceptor 10 is transferred to a recording medium P by a transfer device 18. Subsequently, toner particles remaining on the surface of the photoreceptor 10 after the transfer are removed by a toner-particle cleaning device 20. Then, while a voltage (for example, a voltage having the same polarity as that of the charge of the image area on the surface of the photoreceptor) is applied, using an external additive cleaning device 22, to the surface of the photoreceptor 10 after the transfer, residual external additive on the surface of the photoreceptor 10 is removed. Finally, using a charge removal device 24, the charge on the surface of photoreceptor 10 after the transfer is removed. After completion of the above image forming process, this image forming process is started again.

When a voltage having the same potential as potential Vb of a region of the surface of the photoreceptor 10 at which a toner image is formed (surface potential Vb of an image area) is applied to the surface of the photoreceptor 10 through the conductive blade 22A, the electric potential of an image area on the surface of the photoreceptor 10 after transfer is measured by an electric potential sensor 22C, and a built-in bias supply is controlled by an external additive cleaning controller 22B according to the detected electric potential, and supplies a required power to the conductive blade 22A, thereby applying the voltage having the above potential.

In conventional techniques, when developing is performed using a toner including an external additive (an external additive attaching to the toner), toner particles indirectly and electrostatically attach to the surface of a photoreceptor with the external additive serving as a spacer at the time of the developing, so that the coulomb force between the photoreceptor and the toner particles is inhibited from becoming so strong as to disenable the transfer of the toner particles in the transfer process. However, in order to remove external additive that has separated from the toner particles in transfer process and that strongly and electrostatically attaches to the surface of the photoreceptor, the friction between a cleaning blade and the surface of the photoreceptor has to be increased, which may obstruct the rotation of the photoreceptor or may cause flipping of the tip of the cleaning blade in the rotation direction of the photoreceptor.

Therefore, in conventional techniques, when the toner particles are removed by a cleaning blade, the friction between cleaning blade and surface of the photoreceptor is adjusted not to be excessively large, and the external additive is allowed to pass the cleaning blade to an appropriate degree. As a result, an image area of the photoreceptor after cleaning by the cleaning blade has more residual external additive than in an area around the image area.

Figure 2B:
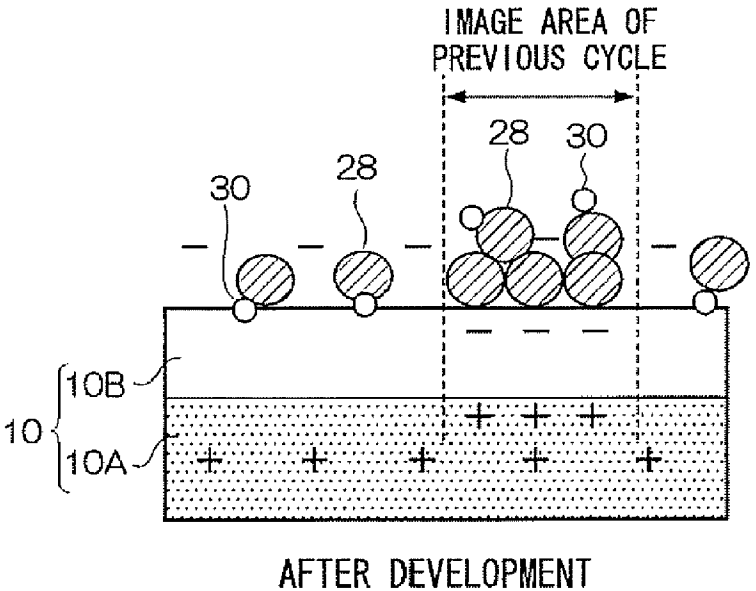
FIGS. 2A and 2B are schematic views for explaining a presumed mechanism of occurrence of ghosting (image unevenness caused by residual history of a previous image) caused by a residual external additive on the photoreceptor.
Figure 2A:
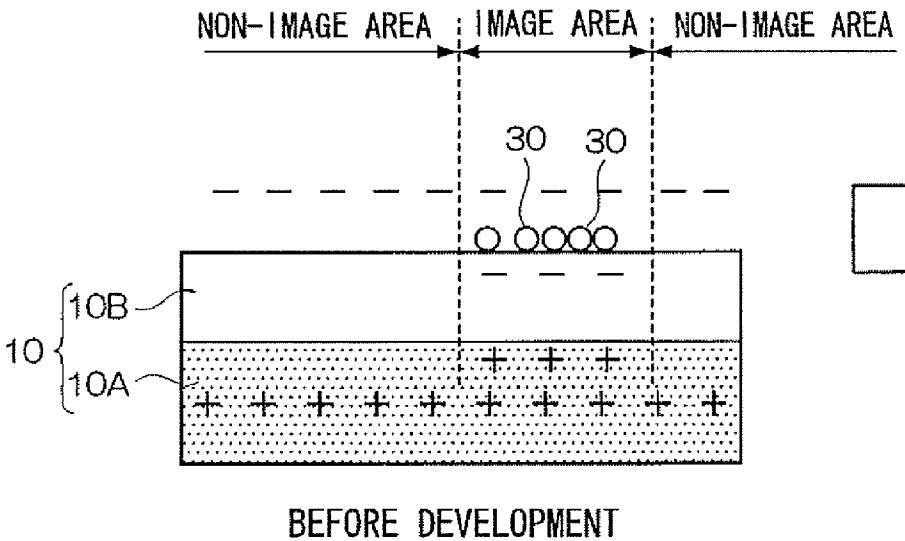

When the photoreceptor in this state is charged again in the next electrophotographic image-forming process cycle, the external additive remaining on the image area on the surface of the photoreceptor is charged together with the photoreceptor (refer to FIG. 2A). When an electrostatic latent image is newly formed on the surface of the photoreceptor in this state by exposure to light and developed (for example, by reversal development using a two-component developer), the external additive remaining on the region that served as an image area in the previous electrophotographic image-forming process cycle is removed by, for example, being rubbed with a magnetic brush or the like of a developing device during development, and is replaced by the toner (refer to FIG. 2B), rather than toner particles' attaching to the surface of the photoreceptor in accordance with the imagewise exposure (in accordance with the electrostatic image). As a result, the quantity of attached toner particles is larger in the region that served as an image area in the previous electrophotographic image-forming process cycle, and the shape of the region that served as an image area in the previous electrophotographic image-forming process cycle is observed as a high-density region, which results in unevenness in the image. This is considered to be caused in the following manner: when the photoreceptor having the attached external additive is charged by a charging device and the external additive is removed by the development process as described above, the electrification quantity of the region of the surface of the photoreceptor to which the external additive attached (the region that served as an image area in the previous cycle) is increased, as a result of which the amount of the toner particles attached to the surface of the photoreceptor is larger in that region than the other region.

FIGS. 2A and 2B are schematic views illustrating a presumed mechanism for the occurrence of ghosting (image unevenness caused by remaining history of the previous image) caused by external additive remaining on the photoreceptor. In FIGS. 2A and 2B, reference numeral 10A represents a charge generating layer of the photoreceptor, reference numeral 10B represents a charge transport layer of the photoreceptor, reference numeral 28 represents toner particles, and reference numeral 30 represents external additive.

In consideration the above issues, in the image forming apparatus 101 according to the present exemplary embodiment, the external additive cleaning device 22 is provided in addition to the toner-particle cleaning device 20. When external additive remaining on the surface of the photoreceptor 10 after transfer is removed by the external additive cleaning device 22, a voltage (for example, a voltage having the same polarity as that of the image area on the surface of the photoreceptor: preferably a voltage having the same potential as the surface potential Vb of the image area) is applied to the surface of the photoreceptor 10 through the conductive blade 22A that contacts the surface of the photoreceptor 10. As a result, it is thought that the electric potential of a non-image area and the electric potential of an image area having the attached external additive on the surface of the photoreceptor 10 become close to each other, so that the electrostatic adhesion force of the attached external additive may be weakened. In this state, the external additive is removed by physical force from the conductive blade 22A.

The image forming apparatus 101 according to the present exemplary embodiment is not limited to above configuration, and may be an image forming apparatus of other known image-forming systems, such as an intermediate-transfer-system image forming apparatus using an intermediate transfer member or a so-called tandem-system image forming apparatus in which image forming units that form toner images of the respective colors are disposed in parallel.

EXAMPLES

The following examples are conducted for evaluating the effects of the image forming apparatus of the present exemplary embodiment.

Example 1A

A conductive blade made of urethane rubber in which graphite is dispersed to adjust the volume resistivity thereof to $10^9$ Ωcm is prepared. The conductive blade is attached to an apparatus modified from a DOCUCENTRE COLOR f450 manufactured by Fuji Xerox Co., Ltd. (a modified apparatus that is adapted to the attachment of an external additive cleaning device (the conductive blade): refer to configuration shown in FIG. 1), such that the normal stress of the cleaning blade is 1.5 gf/cm$^2$. As a developer, a two-component black developer for DOCUCENTRE COLOR f450 (tradename, manufactured by Fuji Xerox Co., Ltd.; the toner has silica as an external additive) is used.

The conductive blade as an external additive cleaning device is attached to the image forming apparatus in following conditions.

- Attachment method: wiper method (an attachment method in which the contact surface of the blade makes an acute angle with the moving direction of the photoreceptor surface)
- Normal stress: 1.5 gf/cm
- Attachment position: downstream of the toner-particle cleaning device with respect to the rotation direction of the photoreceptor but upstream of the charge removal device with respect to the rotation direction of the photoreceptor
- Voltage applied to the surface of the photoreceptor through the conductive blade during image formation: a DC voltage having the same potential as the surface potential Vb (−150V) of an image area.

Using this image forming device, a pattern image (character "X" having a font size of 72 points) is formed on plain paper (C2 paper manufactured by Fuji Xerox Co., Ltd.), and then a halftone image (at an image-forming density of 50%) is formed. Ghosting (unevenness in the image due to remaining history of a previous image) is evaluated according to the following evaluation criteria. Further, the photoreceptor after the formation of the pattern image (character "X") is taken out, and the attachment condition of the external additive in the image area on the surface of the photoreceptor is evaluated visually under an optical microscope according to the following criteria.

—Evaluation Criterion for Ghosting—

A: ghosting does not occur at all

B: extremely slight ghosting occurs and is hardly detectable by the naked eye

C: slight ghosting occurs, but the image quality is at substantially acceptable level D: moderate ghosting occurs, and the image quality is at problematic level E: ghosting clearly occurs —Evaluation Criterion for Attachment Condition of External Additive—

A: external additive does not attach at all

B: external additive attaches extremely slightly

C: external additive attaches sparsely

D: external additive attaches in a larger attachment amount than that of C

E: external additive attaches at high density

Examples 1B to 1C

Evaluations are conducted in the same manner as in Example 1A, except that the voltage applied to the photoreceptor surface by the conductive blade as an external additive cleaning device at the time of image formation is changed as shown in Table 1. The basis for the applied voltages shown in Table 1 is the surface potential Vb (−150 V) of the image area of the photoreceptor.

TABLE 1

| | Example 1A | Example 1B | Example 1C |
|---|---|---|---|
| Applied voltage | Vb | 0.75 Vb | 1.25 Vb |
| Attachment condition of external additive | B | C | B |
| Ghosting | B | C | C* |

Notes

*overall density decreases

Examples 2A to 2F

Evaluations are conducted in the same manner as in example 1A, except that the voltage applied to the photoreceptor surface by the conductive blade as an external additive cleaning device at the time of image formation is changed to a voltage in which an AC voltage is superposed on a DC voltage having the same potential as the surface potential Vb of the image area such that the AC component of the applied voltage is as shown in Table 2 (frequency, peak-to-peak voltage).

TABLE 2

| | Example 2A | Example 2B | Example 2C | Example 2D | Example 2E | Example 2F |
|---|---|---|---|---|---|---|
| Frequency of AC component of applied voltage (kHz) | 1 | 1 | 1 | 0.5 | 0.5 | 3 |
| Peak-to-peak voltage of AC component of applied voltage (V) | Vb/2 | Vb/4 | Vb | Vb/2 | Vb/4 | Vb/3 |
| Attachment condition of external additive | B | B | C | B | C | C |
| Ghosting | B | B | C | B | C | C |

Examples 3A to 3F

Evaluations are conducted in the same manner as in Example 1A, except that the conductive blade is vibrated in the axial direction of the photoreceptor at an amplitude and a vibration frequency shown in Table 3.

TABLE 3

| | Example 3A | Example 3B | Example 3C | Example 3D | Example 3E | Example 3F |
|---|---|---|---|---|---|---|
| Vibration amplitude (mm) | 3.0 | 3.5 | 0.8 | 0.8 | 4.5 | 4.5 |
| Frequency (cycle/sec) | 3 | 0.5 | 3 | 6 | 0.5 | 3 |
| Attachment condition of external additive | B | B | C | C | C | B |
| Ghosting | B | B | C | C | C | B |

Examples 4A~4B

Evaluations are conducted in the same manner as in Example 1A, except that the addition amount of the conductive agent in the conductive blade is changed so as to give the volume resistivity shown in Table 4.

TABLE 4

| | Example 4A | Example 4B |
|---|---|---|
| Volume resistivity (Ωcm) | $10^9$ | $10^{11}$ |
| Attachment condition of external additive | A | B |
| Ghosting | A | B |

Example 5A

Evaluations are conducted in the same manner as in Example 1A, except that the cleaning blade is replaced by a cleaning blade in which a conductive layer is formed on the surface of a blade made of urethane rubber, the conductive layer having oxygen-deficient tin oxide powder dispersed in polyurethane resin and having a volume resistivity of $10^{9.5}$ Ωcm.

Example 5B

Evaluations are conducted in the same manner as in Example 1A, except that the position of the conductive blade is changed to a position at the upstream of the toner-particle cleaning device with respect to the rotation direction of the photoreceptor but at the downstream of the transfer device with respect to the rotation direction of the photoreceptor.

Example 5C

Evaluations are conducted in the same manner as in Example 1A, except that the position of the conductive blade is changed to a position at the downstream of the charge removal device with respect to the rotation direction of the photoreceptor but at the upstream of the charging device with respect to the rotation direction of the photoreceptor.

Comparative Example 1

Evaluations are conducted in the same manner as in Example 1A, except that the conductive blade is not provided.

TABLE 5

| | Example 5A | Example 5B | Example 5C | Comparative Example 1 |
|---|---|---|---|---|
| Attachment condition of external additive | A | C | C | E |
| Ghost | A | C | C | E |

From the above results, it is understood that the external additive attached to the photoreceptor is more efficiently removed and ghosting is more suppressed in the Examples than in the Comparative Example.

In each Example, it is unnecessary to restrain the external additive from passing the toner-particle cleaning blade of the toner-particle cleaning device, so that the normal stress, which is usually from 3.5 gf/cm to 7 gf/cm, can be weakened to be, for example, 1.5 gf/cm while maintaining comparable evaluation results with respect to the attachment condition of the external additive and ghosting. Therefore, it is understood that the image forming apparatuses of the Examples are excellent also in terms of suppression of excessive abrasion of the photoreceptor.

What is claimed is:

1. An image forming apparatus comprising:

an image holder;

a charging unit that charges the image holder;

a latent image forming unit that forms a latent image on a surface of the charged image holder;

a developing unit that develops the latent image formed on the surface of the image holder to form a toner image, using a toner including toner particles and an external additive;

a transfer unit that transfers the toner image formed on the surface of the image holder onto a recording medium;

a toner-particle removal unit that removes toner particles remaining on the surface of the image holder after the transfer of the toner image by the transfer unit; and an external-additive removal unit that includes a conductive blade disposed to contact the surface of the image holder and removes, after the transfer of the toner image by the transfer unit, external additive remaining on the surface of the image holder using the conductive blade while applying a voltage to the surface of the image holder via the conductive blade, wherein an electric potential of a DC component of the voltage applied via the conductive blade is substantially the same as an electric potential Vb of a region of the surface of the image holder carrying the toner image.

2. The image forming apparatus according to claim 1, wherein the voltage applied via the conductive blade is a voltage in which an AC voltage is superposed on a DC voltage.

3. The image forming apparatus according to claim 1, wherein the conductive blade is vibrated in an axial direction of the image holder.

4. The image forming apparatus according to claim 3, wherein the vibration of the conductive blade has an amplitude of from about 1 mm to about 10 mm and a frequency of from about 0.1 cyc/sec to about 15 cyc/sec.

5. The image forming apparatus according to claim 1, further comprising a charge removal unit that removes charge from the surface of the image holder after the transfer of the toner image by the transfer unit, and wherein the conductive blade is provided downstream of the toner-particle removal unit with respect to a rotation direction of the image holder but upstream of the charge removal unit with respect to the rotation direction of the image holder.

6. The image forming apparatus according to claim 1, wherein the external-additive removal unit includes an electric potential detection unit.

7. The image forming apparatus according to claim 1, wherein the conductive blade is oriented toward a rotational direction of the image holder.

8. The image forming apparatus according to claim 1, wherein a volume resistivity of the conductive blade is from about $10^7$ Ωcm to about $10^{12}$ Ωcm.

9. The image forming apparatus according to claim 1, wherein the conductive blade includes a resin or a rubber, in which a conductive agent is dispersed.

10. The image forming apparatus according to claim 1, wherein the conductive blade comprises a resin or a rubber, a conductive layer including a conductive agent is provided on the blade.

11. An image forming apparatus comprising:

an image holder;

a charging unit that charges the image holder;

a latent image forming unit that forms a latent image on a surface of the charged image holder;

a developing unit that develops the latent image formed on the surface of the image holder to form a toner image, using a toner including toner particles and an external additive;

a transfer unit that transfers the toner image formed on the surface of the image holder onto a recording medium;

a toner-particle removal unit that removes toner particles remaining on the surface of the image holder after the transfer of the toner image by the transfer unit; and an external-additive removal unit that includes a conductive blade disposed to contact the surface of the image holder and removes, after the transfer of the toner image by the transfer unit, external additive remaining on the surface of the image holder using the conductive blade while applying a voltage to the surface of the image holder via the conductive blade, wherein a normal stress of the conductive blade with respect to the image holder is from about 0.5 gf/cm to about 3.5 gf/cm.

12. The image forming apparatus according to claim 11, wherein an electric potential of a DC component of the voltage applied via the conductive blade is substantially the same as an electric potential Vb of a region of the surface of the image holder carrying the toner image.

13. The image forming apparatus according to claim 12, wherein the voltage applied via the conductive blade is a voltage in which an AC voltage is superposed on a DC voltage.

14. The image forming apparatus according to claim 11, wherein the conductive blade is vibrated in an axial direction of the image holder.

15. The image forming apparatus according to claim 14, wherein the vibration of the conductive blade has an amplitude of from about 1 mm to about 10 mm and a frequency of from about 0.1 cyc/sec to about 15 cyc/sec.

16. The image forming apparatus according to claim 11, further comprising a charge removal unit that removes charge from the surface of the image holder after the transfer of the toner image by the transfer unit, and wherein the conductive blade is provided downstream of the toner-particle removal unit with respect to a rotation direction of the image holder but upstream of the charge removal unit with respect to the rotation direction of the image holder.

17. The image forming apparatus according to claim 11, wherein the external-additive removal unit includes an electric potential detection unit.

18. The image forming apparatus according to claim 11, wherein the conductive blade is oriented toward a rotational direction of the image holder.

19. The image forming apparatus according to claim 11, wherein a volume resistivity of the conductive blade is from about $10^7$ Ωcm to about $10^{12}$ Ωcm.

20. The image forming apparatus according to claim 11, wherein the conductive blade includes a resin or a rubber, in which a conductive agent is dispersed.

21. The image forming apparatus according to claim 11, wherein the conductive blade comprises a resin or a rubber, a conductive layer including a conductive agent is provided on the blade.

* * * * *